US011530597B2

(12) United States Patent
Saeed et al.

(10) Patent No.: US 11,530,597 B2
(45) Date of Patent: Dec. 20, 2022

(54) DOWNHOLE WIRELESS COMMUNICATION

(71) Applicants: Saudi Arabian Oil Company, Dhahran (SA); WIRELESS INSTRUMENTATION SYSTEMS AS, Trondheim (NO)

(72) Inventors: Abubaker Saeed, Dhahran (SA); Jarl André Fellinghaug, Leinstrand (NO); Henrik Wanvik Clayborough, Trondheim (NO); Vegard Fiksdal, Trondheim (NO)

(73) Assignees: Saudi Arabian Oil Company, Dhahran (SA); WIRELESS INSTRUMENTATION SYSTEMS AS, Trondheim (NO)

( * ) Notice: Subject to any disclaimer, the term of this patent is extended or adjusted under 35 U.S.C. 154(b) by 36 days.

(21) Appl. No.: 17/178,880

(22) Filed: Feb. 18, 2021

(65) Prior Publication Data

US 2022/0259950 A1 Aug. 18, 2022

(51) Int. Cl.

| | |
|---|---|
| ***E21B 41/00*** | (2006.01) |
| ***E21B 47/18*** | (2012.01) |
| ***E21B 34/16*** | (2006.01) |

(52) U.S. Cl.

CPC ..... *E21B 41/0085* (2013.01); *E21B 34/16* (2013.01); *E21B 47/18* (2013.01)

(58) Field of Classification Search

CPC ..... E21B 41/0085; E21B 47/18; E21B 34/16; E21B 21/08

See application file for complete search history.

(56) References Cited

U.S. PATENT DOCUMENTS

| | | | |
|---|---|---|---|
| 2,643,723 | A | 6/1953 | Lynes |
| 3,175,618 | A | 3/1965 | Lang et al. |

(Continued)

FOREIGN PATENT DOCUMENTS

| | | |
|---|---|---|
| CN | 101592475 | 12/2009 |
| CN | 201496028 | 6/2010 |

(Continued)

OTHER PUBLICATIONS

Bao et al., "Recent development in the distributed fiber optic acoustic and ultrasonic detection," Journal of Lightwave Technology, Aug. 15, 2017, 35:16 (3256-3267), 12 pages.

(Continued)

*Primary Examiner* — Brad Harcourt
(74) *Attorney, Agent, or Firm* — Fish & Richardson P.C.

(57) ABSTRACT

A system includes a surface sub-system and a downhole sub-system. The surface subsystem includes a pump and a surface valve sub-assembly. The pump is configured to pump a fluid from a container, downhole into a wellbore. The surface valve sub-assembly is fluidically coupled to the pump and configured to receive a first portion of the fluid pumped by the pump. The surface valve sub-assembly includes a dump valve, a surface controller, and a return line. The surface controller is configured to adjust fluid flow through the dump valve, and the return line is configured to flow fluid from the dump valve to the container. The downhole sub-system includes a turbine-generator and a downhole controller coupled to the turbine-generator. The turbine-generator is configured to generate an output in response to receiving a second portion of the fluid pumped by the pump.

15 Claims, 8 Drawing Sheets

(56) References Cited

U.S. PATENT DOCUMENTS 3,448,305 A 6/1969 Raynal et al.
3,558,936 A 1/1971 Horan
3,663,845 A 5/1972 Apstein
3,916,999 A 11/1975 Ellis et al.
3,918,520 A 11/1975 Hutchison
3,970,877 A 7/1976 Russell et al.
4,387,318 A 6/1983 Kolm et al.
4,536,674 A 8/1985 Schmidt
4,685,523 A 8/1987 Paschal, Jr. et al.
5,092,176 A 3/1992 Buttram et al.
5,113,379 A 5/1992 Scherbatskoy
5,150,619 A 9/1992 Turner
5,224,182 A 6/1993 Murphy et al.
5,301,760 A 4/1994 Graham
5,317,223 A 5/1994 Kiesewetter et al.
5,375,622 A 12/1994 Houston
5,448,227 A 9/1995 Orban et al.
5,566,762 A 10/1996 Braddick et al.
5,613,555 A 3/1997 Sorem et al.
5,708,500 A 1/1998 Anderson
5,892,860 A 4/1999 Maron et al.
5,965,964 A 10/1999 Skinner et al.
5,975,205 A 11/1999 Carisella
6,044,906 A 4/2000 Saltel
6,068,015 A 5/2000 Pringle
6,082,455 A 7/2000 Pringle et al.
6,193,079 B1 2/2001 Weimer
6,209,652 B1 4/2001 Portman et al.
6,349,768 B1 2/2002 Leising
6,504,258 B2 1/2003 Schultz et al.
6,578,638 B2 6/2003 Guillory et al.
6,588,266 B2 7/2003 Tubel et al.
6,728,165 B1 4/2004 Roscigno et al.
6,768,214 B2 7/2004 Schultz et al.
6,779,601 B2 8/2004 Wilson
6,913,079 B2 7/2005 Tubel
6,920,085 B2 7/2005 Finke et al.
7,198,102 B2 * 4/2007 Virally ..... E21B 21/08 166/249
7,199,480 B2 4/2007 Fripp et al.
7,224,077 B2 5/2007 Allen
7,242,103 B2 7/2007 Tips
7,249,805 B2 7/2007 Cap
7,345,372 B2 3/2008 Roberts et al.
7,397,388 B2 7/2008 Huang et al.
7,410,003 B2 8/2008 Ravensbergen et al.
7,668,411 B2 2/2010 Davies et al.
7,847,421 B2 12/2010 Gardner et al.
7,906,861 B2 3/2011 Guerrero et al.
7,946,341 B2 5/2011 Hartog et al.
7,980,309 B2 7/2011 Crawford
8,047,232 B2 11/2011 Bernitsas
8,258,644 B2 9/2012 Kaplan
8,408,064 B2 4/2013 Hartog et al.
8,421,251 B2 4/2013 Pabon et al.
8,426,988 B2 4/2013 Hay
8,493,556 B2 7/2013 Li et al.
8,564,179 B2 10/2013 Ochoa et al.
8,604,634 B2 12/2013 Pabon et al.
8,638,002 B2 1/2014 Lu
8,648,480 B1 2/2014 Liu et al.
8,681,000 B2 3/2014 August et al.
8,786,113 B2 7/2014 Tinnen et al.
8,792,304 B2 * 7/2014 Sugiura ..... E21B 47/18 340/854.3
8,916,983 B2 12/2014 Marya et al.
8,925,649 B1 1/2015 Wiebe et al.
8,941,384 B2 1/2015 Prammer
8,948,550 B2 2/2015 Li et al.
9,026,376 B2 5/2015 Volker et al.
9,091,144 B2 7/2015 Swanson et al.
9,106,159 B1 8/2015 Wiebe et al.
9,130,161 B2 9/2015 Nair et al.
9,140,815 B2 9/2015 Lopez et al.
9,170,149 B2 10/2015 Hartog et al.
9,239,043 B1 1/2016 Zeas
9,321,222 B2 4/2016 Childers et al.
9,322,389 B2 4/2016 Tosi
9,499,460 B2 11/2016 Kawamura et al.
9,574,420 B2 2/2017 Hall et al.
9,581,489 B2 2/2017 Skinner
9,599,460 B2 3/2017 Wang et al.
9,599,505 B2 3/2017 Lagakos et al.
9,605,535 B2 3/2017 Logan et al.
9,617,847 B2 4/2017 Jaaskelainen et al.
9,638,671 B2 5/2017 Borigo et al.
9,759,556 B2 9/2017 Davis et al.
9,784,077 B2 10/2017 Gorrara
9,803,976 B2 10/2017 Simonetti et al.
9,828,853 B2 * 11/2017 Chambers ..... E21B 34/066
10,115,942 B2 10/2018 Qiao et al.
10,209,383 B2 2/2019 Barfoot et al.
10,253,615 B2 4/2019 Hunter et al.
10,367,434 B2 7/2019 Ahmad
2002/0043404 A1 4/2002 Trueman et al.
2006/0042792 A1 3/2006 Connell
2006/0086498 A1 4/2006 Wetzel et al.
2007/0012437 A1 1/2007 Clingman et al.
2007/0181304 A1 8/2007 Rankin et al.
2008/0048455 A1 2/2008 Carney
2008/0100828 A1 5/2008 Cyr et al.
2008/0277941 A1 11/2008 Bowles
2008/0296067 A1 12/2008 Haughom
2009/0107725 A1 4/2009 Christy et al.
2009/0166045 A1 7/2009 Wetzel et al.
2010/0164231 A1 7/2010 Tsou
2010/0308592 A1 12/2010 Frayne
2011/0049901 A1 3/2011 Tinnen
2011/0088462 A1 4/2011 Samson et al.
2011/0273032 A1 11/2011 Lu
2012/0018143 A1 1/2012 Lembcke
2012/0211245 A1 8/2012 Fuhst et al.
2012/0292915 A1 11/2012 Moon
2013/0068481 A1 3/2013 Zhou
2013/0091942 A1 4/2013 Samson et al.
2013/0119669 A1 5/2013 Murphree
2013/0167628 A1 7/2013 Hull et al.
2013/0200628 A1 8/2013 Kane
2013/0227940 A1 9/2013 Greenblatt
2013/0234859 A1 9/2013 Picioreanu et al.
2014/0167418 A1 6/2014 Hiejima
2014/0175800 A1 6/2014 Thorp
2014/0284937 A1 9/2014 Dudley et al.
2014/0311737 A1 10/2014 Bedouet et al.
2015/0053009 A1 2/2015 Yan et al.
2015/0060083 A1 3/2015 Romer et al.
2015/0114127 A1 4/2015 Barfoot et al.
2015/0318920 A1 11/2015 Johnston
2016/0168957 A1 6/2016 Tubel
2016/0177659 A1 6/2016 Voll et al.
2016/0273947 A1 9/2016 Mu et al.
2016/0333670 A1 * 11/2016 Tegeler ..... H02M 7/219
2017/0033713 A1 2/2017 Petroni
2017/0075029 A1 3/2017 Cuny et al.
2017/0235006 A1 8/2017 Ellmauthaler et al.
2017/0260846 A1 9/2017 Jin et al.
2018/0045543 A1 2/2018 Farhadiroushan et al.
2018/0052041 A1 2/2018 Yaman et al.
2018/0155991 A1 6/2018 Arsalan et al.
2018/0274311 A1 9/2018 Zsolt
2018/0351480 A1 12/2018 Ahmad
2019/0025095 A1 1/2019 Steel
2019/0049054 A1 2/2019 Gunnarsson
2019/0055792 A1 2/2019 Sui et al.
2019/0128113 A1 5/2019 Ross et al.
2019/0253003 A1 8/2019 Ahmad
2019/0253004 A1 8/2019 Ahmad
2019/0253005 A1 8/2019 Ahmad
2019/0253006 A1 8/2019 Ahmad
2019/0376371 A1 12/2019 Arsalan
2020/0270983 A1 8/2020 Hallunbaek et al.
2020/0310389 A1 10/2020 Han et al.

(56) References Cited

U.S. PATENT DOCUMENTS

2020/0370426 A1* 11/2020 Dugas ..... E21B 47/00
2021/0348508 A1* 11/2021 Greci ..... E21B 41/0085

FOREIGN PATENT DOCUMENTS

| | | |
|---|---|---|
| CN | 102471701 | 5/2012 |
| CN | 101488805 | 8/2012 |
| CN | 103913186 | 7/2014 |
| CN | 105043586 | 11/2015 |
| CN | 107144339 | 9/2017 |
| CN | 206496768 | 9/2017 |
| CN | 105371943 | 6/2018 |
| CN | 108534910 | 9/2018 |
| DE | 202012103729 | 10/2012 |
| EP | 0380148 | 8/1990 |
| GB | 2218721 | 11/1989 |
| JP | 2010156172 | 7/2010 |
| WO | WO 1993006331 | 4/1993 |
| WO | WO 2009046709 | 4/2009 |
| WO | WO 2014116458 | 7/2014 |
| WO | WO 2015073018 | 5/2015 |
| WO | WO 2016111849 | 7/2016 |
| WO | WO 2016130620 | 8/2016 |
| WO | WO 2017146593 | 8/2017 |
| WO | WO 2018125071 | 7/2018 |
| WO | WO 2018145215 | 8/2018 |

OTHER PUBLICATIONS

Bybee et al., "Through-Tubing Completions Maximize Production," SPE-0206-0057, Society of Petroleum Engineers (SPE), Drilling and Cementing Technology, JPT, Feb. 2006, 2 pages.
Chen et al., "Distributed acoustic sensor based on two-mode fiber," Optics Express 25399, Optics Express, Sep. 2018, 26:19, 9 pages.
Cox et al., "Realistic Assessment of Proppant Pack Conductivity for Material Section," SPE-84306-MS, Society of Petroleum Engineers (SPE), presented at the Annual Technical Conference, Oct. 5-8, 2003, 12 pages.
Fornarelli et al., "Flow patterns and heat transfer around six in-line circular cylinders at low Reynolds number," JP Journal of Heat and Mass Transfer, Pushpa Publishing House, Allahabad, India, Feb. 2015, 11:1 (1-28), 28 pages.
Gillard et al., "A New Approach to Generating Fracture Conductivity," SPE-135034-MS, Society of Petroleum Engineers (SPE), presented at the SPE Annual Technical Conference and Exhibition, Sep. 19-22, 2010, 14 pages.
Gomaa et al., "Computational Fluid Dynamics Applied To Investigate Development and Optimization of Highly Conductive Channels within the Fracture Geometry," SPE-179143-MS, Society of Petroleum Engineers (SPE), SPE Production & Operations, 32:04, Nov. 2017, 12 pages.
Gomaa et al., "Improving Fracture Conductivity by Developing and Optimizing a Channels Within the Fracture Geometry: CFD Study," SPE-178982-MS, Society of Petroleum Engineers (SPE), SPE International Conference and Exhibition on Formation Damage Control, Feb. 24-26, 2016, 25 pages.
Govardhan et al., "Critical mass in vortex-induced vibration of a cylinder," European Journal of Mechanics B/Fluids, Jan.-Feb. 2004, 23:1 (17-27), 11 pages.
Huthwaite, "Evaluation of inversion approaches for guided wave thickness mapping," Proceedings of the Royal Society A, Mar. 2014, 470:20140063, 28 pages.
Huthwaite, "Improving accuracy through density correction in guided wave tomography," Proceedings of the Royal Society A, Jan. 2016, 472:20150832, 25 pages.
Juarez and Taylor, "Field test of a distributed fiber-optic intrusion sensor system for long perimeters," Applied Optics, Apr. 10, 2007, 46:11 (1968-1971), 4 pages.
Keiser, "Optical fiber communications," McGraw Hill, 2008, 26-57, 16 pages.
Kern et al., "Propping Fractures With Aluminum Particles," SPE-1573-G-PA, Society of Petroleum Engineers (SPE), Journal of Per. Technology, Jun. 1961, 13:6 (583-589), 7 pages.
Meyer et al., "Theoretical Foundation and Design Formulae for Channel and Pillar Type Propped Fractures—A Method to Increase Fracture Conductivity," SPE-170781-MS, Society Of Petroleum Engineers (SPE), presented at the SPE Annual Technical Conference and Exhibition, Amsterdam, The Netherlands, Oct. 27-29, 2014, 25 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 SPE Hydraulic Fracturing Technology Conference, College Station, Texas, Jan. 29-31, 2007, 13 pages.
Petrowiki.spe.org (online), "Scale Problems in Production," available on or before Jan. 15, 2018, retrieved on Feb. 16, 2021, retrieved from URL <https://petrowiki.spe.org/Scale_problems_in_production>, 15 pages.
Poollen et al., "Hydraulic Fracturing—FractureFlow Capacity vs Well Productivity," SPE-890-G, Society of Petroleum Engineers (SPE), presented at 32nd Annual Fall Meeting of Society of Petroleum Engineers, Oct. 6-9, 1957, published as Petroleum Transactions AIME 213, 1958, 5 pages.
Poollen, "Productivity vs Permeability Damage in Hydraulically Produced Fractures," Paper 906-2-G, American Petroleum Institute, presented at Drilling and Production Practice, Jan. 1, 1957, 8 pages.
Qin et al., "Signal-to-Noise Ratio Enhancement Based on Empirical Mode Decomposition in Phase-Sensitive Optical Time Domain Reflectometry Systems," Sensors, MDPI, Aug. 14, 2017, 17:1870, 10 pages.
Rao et al., "Guided Wave Tomography Based on Full Waveform Inversion," IEEE Transactions on Ultrasonics, Ferroelectrics and Frequency Control, May 2016, 63:5, 9 pages.
Rao et al., "Guided Wave Tomography Based on Full Waveform Inversion," Manuscript, The School of Mechanical and Aerospace Engineering, Nanyang Technology University, Feb. 26, 2016, 33 pages.
Saeed et al., "Innovative Permanent Down-Hole Scale and Corrosion Monitoring SystemUsing Ultrasound Guided Waves Technology," SPE-198609-MS, Society of Petroleum Engineers (SPE), presented at the SPE Gas & Oil Technology Showcase and Conference, Dubai, UAE, Oct. 21-23, 2019, 10 pages.
Stalford et al., "Literature Survey and Background Studies Report (Task V)," Document No. 10121.4504.01.01, Intelligent Casing-Intelligent Formation Telemetry (ICIFT) System, Research Partnership of Secure Energy for America (RPSEA), Jul. 15, 2014, 90 pages.
Tinsley and Williams, "A new method for providing increased fracture conductivity and improving stimulation results," SPE-4676-PA, Society of Petroleum Engineers (SPE), Journal of Petroleum Technology, Nov. 1975, 27:11 (1319-1325), 7 pages.
Vincent, "Examining Our Assumptions—Have Oversimplifications Jeopardizedour Ability To Design Optimal Fracture Treatments," SPE-119143-MS, Society of Petroleum Engineers (SPE), presented at the SPE Hydraulic Fracturing Technology Conference, the Woodlands, Texas, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Vysloukh, "Chapter 8: Stimulated Raman Scattering," in Nonlinear Fiber Optics, 1990, 298-302, 5 pages.
Walker et al., "Proppants, We Still Don't Need No Proppants—A Perspective of Several Operators," SPE-38611-MS, Society of Petroleum Engineers (SPE), presented at the SPE Annual Technical Conference and Exhibition, San Antonio, Texas, Sep. 27-30, 1995, 8 pages.
Wang et al., "Rayleigh scattering in few-mode optical fibers," Scientific reports, Oct. 2016, 6:35844 (1-8), 8 pages.
Yamate et al., "Optical sensors for the exploration of oil and gas," Journal of Lightwave Technology, Aug. 15, 2017, 35:16 (3538-3545), 8 pages.

(56) References Cited

OTHER PUBLICATIONS

International Search Report and Written Opinion in International Appln. No. PCT/US2022/16967, dated May 16, 2022, 13 pages.

* cited by examiner

DOWNHOLE WIRELESS COMMUNICATION

TECHNICAL FIELD

This disclosure relates to surface to downhole wireless communication.

BACKGROUND

Downhole communication in a wellbore involves communication between surface equipment disposed at or above a surface of the wellbore and downhole equipment disposed within the wellbore. For example, a signal can be transmitted from surface equipment to downhole equipment. For example, a signal can be transmitted from downhole equipment to surface equipment. The communication can be completed via a wired connection (for example, a wireline) or via a wireless connection. Downhole communication can also involve communication between two different equipment located downhole.

SUMMARY

This disclosure describes technologies relating to downhole wireless communication. Certain aspects of the subject matter described can be implemented as a system. The system includes a surface sub-system and a downhole sub-system. The surface sub-system includes a pump and a surface valve sub-assembly. The pump is configured to pump a fluid from a container, downhole into a wellbore. The surface valve sub-assembly is fluidically coupled to the pump and configured to receive a first portion of the fluid pumped by the pump. The surface valve sub-assembly includes a dump valve, a surface controller, and a return line. The surface controller is communicatively coupled to the dump valve. The surface controller is configured to adjust fluid flow through the dump valve. The return line is in fluid communication with the dump valve. The return line is configured to flow fluid from the dump valve to the container. The downhole sub-system is coupled to the surface valve sub-assembly and configured to be disposed within the wellbore. The downhole sub-system includes a turbine-generator and a downhole controller. The turbine-generator is configured to generate an output in response to receiving a second portion of the fluid pumped by the pump.

This, and other aspects, can include one or more of the following features.

In some implementations, the dump valve is a first dump valve. In some implementations, the surface valve sub-assembly includes a second dump valve. In some implementations, the first dump valve and the second dump valve are in a parallel flow configuration.

In some implementations, the downhole sub-system and the surface valve sub-assembly are coupled by a coiled tubing that fluidically couples the pump to the turbine-generator.

In some implementations, the surface controller includes a surface processor and a surface computer-readable storage medium coupled to the surface processor. In some implementations, the surface computer-readable storage medium is non-transitory. In some implementations, the surface computer-readable storage medium stores programming instructions for execution by the surface processor. In some implementations, the programming instructions instruct the surface processor to perform operations including adjusting an amount of the first portion of the fluid pumped by the pump by adjusting fluid flow through each of the first dump valve and the second dump valve, such that a sinusoidal signal is hydraulically transmitted to the downhole sub-system via the second portion of the fluid pumped by the pump.

In some implementations, the turbine-generator is configured to receive the sinusoidal signal via the second portion of the fluid pumped by the pump and change the output in response to the receiving the sinusoidal signal, and the downhole controller is configured to process the change in the output.

In some implementations, the surface controller is configured to modulate the sinusoidal signal that is hydraulically transmitted to the downhole sub-system via the second portion of the fluid pumped by the pump, and the downhole controller is configured to de-modulate the sinusoidal signal that is hydraulically transmitted to the downhole sub-system via the second portion of the fluid pumped by the pump.

In some implementations, the downhole controller is configured to process the change in the output of the turbine-generator, such that a power output of the turbine-generator is maintained to be greater than a minimum power output threshold.

Certain aspects of the subject matter can be implemented as a method. A first portion of a fluid from a container is flowed to a surface valve sub-assembly. The surface valve sub-assembly includes a dump valve, a surface controller communicatively coupled to the dump valve, and a return line in fluid communication with the dump valve. Fluid flow through the dump valve is adjusted by the surface controller. The first portion of the fluid is flowed to the container by the return line. A second portion of the fluid is flowed from the container to a downhole sub-system disposed within a wellbore. The downhole sub-system includes a turbine-generator and a downhole controller coupled to the turbine-generator. The second portion of the fluid is received by the turbine-generator. An output is generated by the turbine-generator in response to receiving the second portion of the fluid. The output from the turbine-generator is received by the downhole controller. A control signal is transmitted by the downhole controller in response to receiving the output from the turbine-generator.

This, and other aspects, can include one or more of the following features.

In some implementations, flowing the second portion of the fluid from the container to the downhole sub-system includes flowing the second portion of the fluid through a coiled tubing fluidically coupled to the turbine-generator.

In some implementations, the dump valve is a first dump valve. In some implementations, the surface valve sub-assembly includes a second dump valve. In some implementations, the first dump valve and the second dump valve are in a parallel flow configuration. In some implementations, a split of the first portion of the fluid between the first dump valve and the second dump valve is adjusted by the surface controller.

In some implementations, adjusting the split of the first portion of the fluid between the first dump valve and the second dump valve comprises adjusting the fluid flow through each of the first dump valve and the second dump valve, such that a sinusoidal signal is hydraulically transmitted to the downhole sub-system via the second portion of the fluid.

In some implementations, the sinusoidal signal is received by the turbine-generator via the second portion of the pump. In some implementations, the output generated by the turbine-generator is changed in response to receiving the sinusoidal signal.

In some implementations, the downhole sub-system includes a circulation valve downstream of the turbine-generator. In some implementations, the circulation valve is communicatively coupled to the downhole controller. In some implementations, the change in the output is processed by the downhole controller. In some implementations, fluid flow through the circulation valve is adjusted by the downhole controller at least based on the processing of the change in the output.

In some implementations, the sinusoidal signal that is hydraulically transmitted to the downhole sub-system via the second portion of the fluid is modulated by the surface controller. In some implementations, the sinusoidal signal that is hydraulically transmitted to the downhole sub-system via the second portion of the fluid is de-modulated by the downhole controller.

In some implementations, processing the change in the output includes processing the change in the output, such that the power output of the turbine-generator is maintained to be greater than a minimum power output threshold.

Certain aspects of the subject matter described can be implemented as a system. The system includes a surface sub-system configured to receive a first portion of a fluid pumped by a pump positioned at a surface location. The surface sub-system includes dump valves, a surface controller, and a return line. The surface controller is communicatively coupled to the dump valves. The surface controller is configured to adjust fluid flow through each of the dump valves. The return line is in fluid communication with the dump valves. The return line is configured to flow fluid from the dump valves to a container that provides feed to the pump. The system includes a downhole sub-system configured to be disposed within a wellbore. The downhole sub-system includes a turbine-generator, a circulation valve, and a downhole controller. The turbine-generator is configured to generate an output in response to receiving a second portion of the fluid pumped by the pump. The circulation valve is downstream of the turbine-generator. The downhole controller is coupled to the turbine-generator and communicatively coupled to the circulation valve. The downhole controller is configured to adjust fluid flow through the circulation valve in response to receiving the output from the turbine-generator.

This, and other aspects, can include one or more of the following features.

In some implementations, the dump valves are in a parallel flow configuration.

In some implementations, the downhole sub-system and the surface sub-system are coupled by a coiled tubing.

In some implementations, the surface controller includes a surface processor and a surface computer-readable storage medium coupled to the surface processor. In some implementations, the surface computer-readable storage medium is non-transitory. In some implementations, the surface computer-readable storage medium stores surface programming instructions for execution by the surface processor. In some implementations, the surface programming instructions instruct the surface processor to perform surface operations. In some implementations, the downhole controller includes a downhole processor and a downhole computer-readable storage medium coupled to the downhole processor. In some implementations, the downhole computer-readable storage medium is non-transitory. In some implementations, the downhole computer-readable storage medium stores downhole programming instructions for execution by the downhole processor. In some implementations, the downhole programming instructions instruct the downhole processor to perform downhole operations.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes downhole wireless communication. Some well operations, such as well intervention, require data (sometimes in the form of command signals) to be communicated downhole to a tool string disposed within a wellbore. Some examples of methods of such downhole communication include the use of a wired connection, pressure or flow fluctuations in a circulation fluid, or pulling and pushing of coiled tubing. Wireless communication can be preferred in some cases, such as acid stimulation in multilateral wells. The systems and methods described in this disclosure include a surface sub-system and a downhole sub-system. Each of the surface and downhole sub-systems include a controller. The surface sub-system includes one or more dump valves that the surface controller controls to adjust flow of fluid downhole into a wellbore as a form of signal transmission for downhole wireless communication. The downhole sub-system disposed within the wellbore includes a turbine-generator that receives the fluid flow. The downhole controller, which is communicatively coupled to the turbine-generator, interprets the signal based on the power generated by the turbine-generator in response to receiving the fluid flow.

The subject matter described in this disclosure can be implemented in particular implementations, so as to realize one or more of the following advantages. The systems and methods described are non-intrusive in the coiled tubing and do not negatively interfere with the pump rate capacity of the coiled tubing, as is typical for conventional electric wires used for wired communication. The systems and methods described can be implemented to perform wireless communication from surface equipment to downhole equipment over long distances, for example, distances of greater than 20,000 feet. The systems and methods described can be implemented to transmit digital data and commands to a downhole toolstring in a stimulation operation in which an electric wire would not be able to be used due to material limitations.

Figure 1:
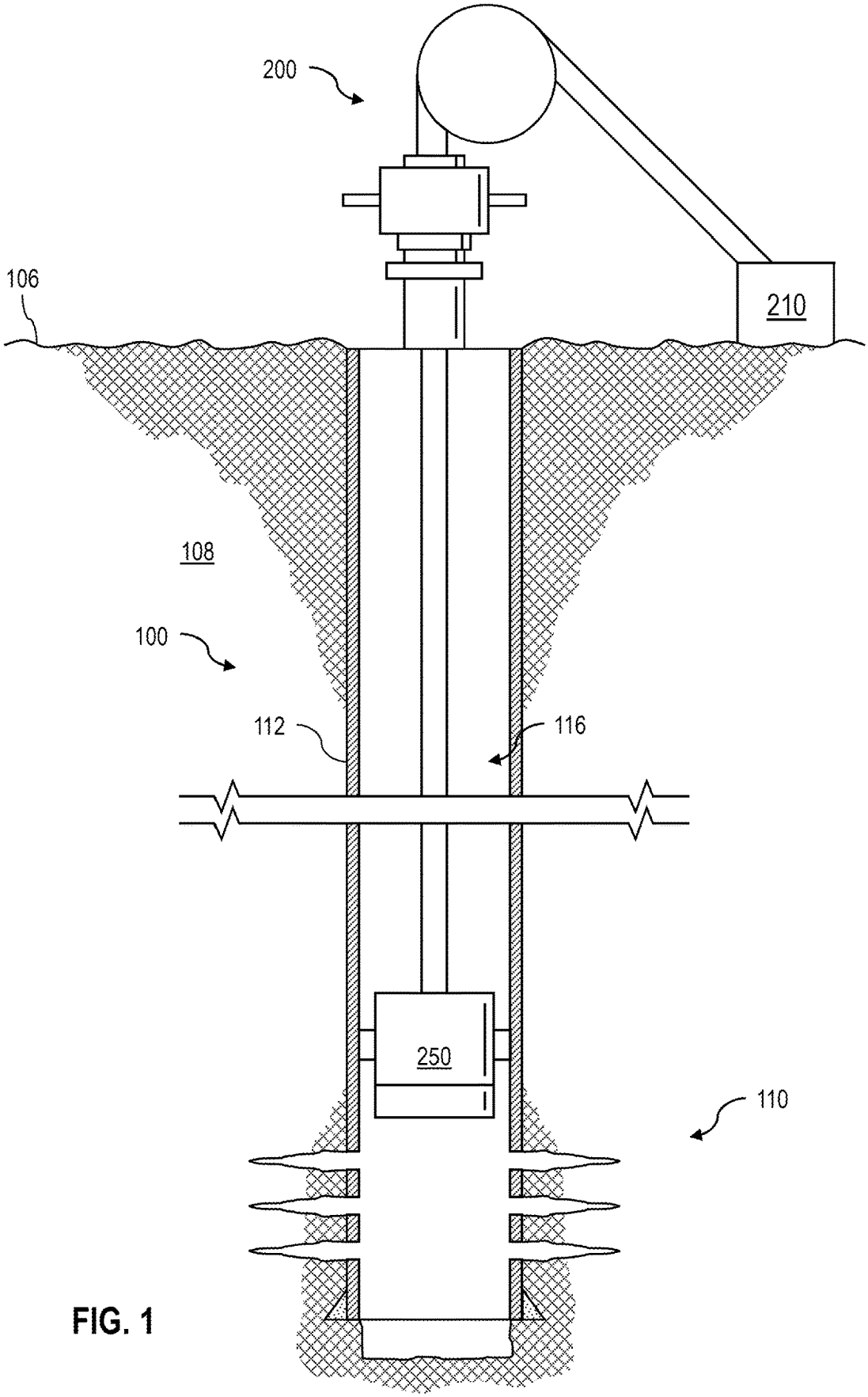
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

As shown in FIG. 1, system 200 can be implemented to establish downhole wireless communication. The system 200 includes a surface sub-system 210 and a downhole sub-system 250 disposed within the well 100. The system 200 is described in more detail later. The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size.

Figure 2A:
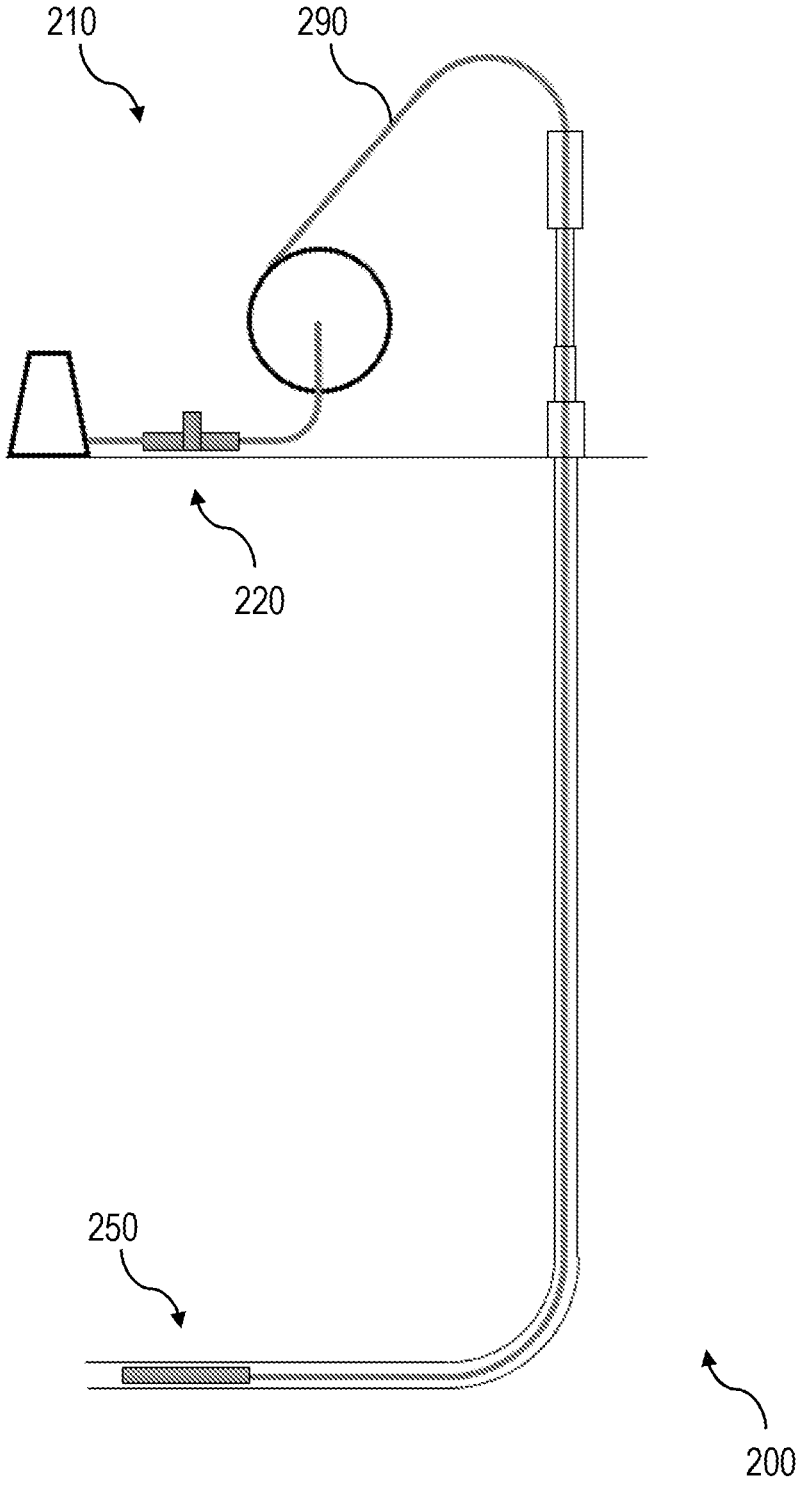
FIG. 2A is a schematic diagram of an example system for wireless communication between surface and downhole equipment.

FIG. 2A depicts an example system 200 that can be implemented in relation to the well 100. The system 200 includes a surface sub-system 210 and a downhole sub-system 250. The downhole sub-system 250 is coupled to the surface sub-system 210. In some implementations, the surface sub-system 210 is coupled to the downhole sub-system 250 by a coiled tubing 290. Fluid can be flowed from the surface sub-system 210 to the downhole sub-system 250 through the coiled tubing 290 to establish wireless communication between the sub-systems 210, 250.

Figure 2B:
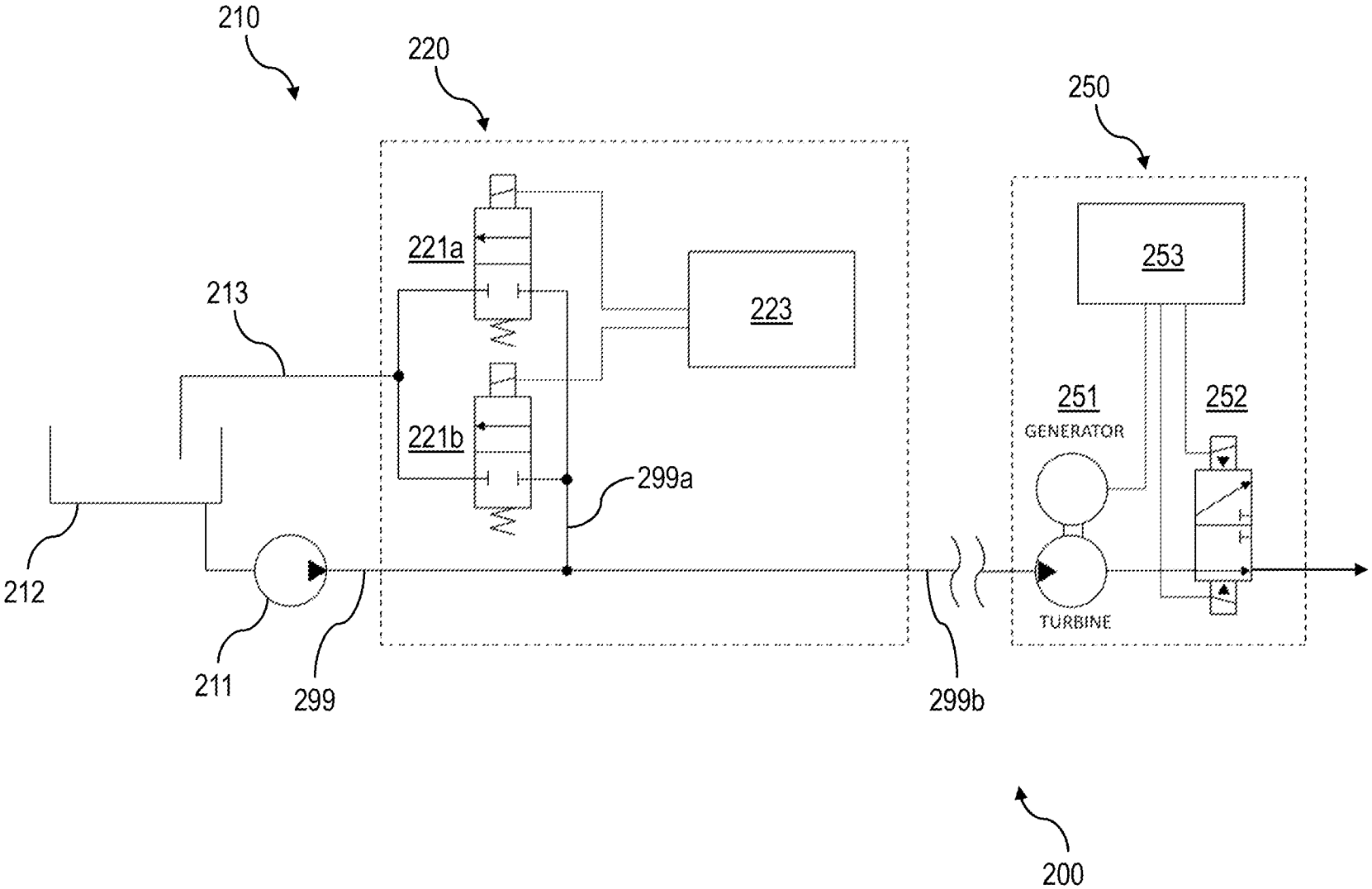
FIG. 2B is a schematic flow diagram of the system of FIG. 2A.

FIG. 2B is a schematic flow diagram of the system 200. The surface sub-system 210 includes a pump 211 configured to pump a fluid 299 from a container 212 downhole into a wellbore (for example, downhole into the well 100). In some implementations, the container 212 is in the form of a sump, a tank, or barrels. The surface sub-system 210 includes a surface valve sub-assembly 220 that is fluidically coupled to the pump 211. The surface valve sub-assembly 220 is configured to receive a first portion 299*a* of the fluid 299 pumped by the pump 211. The surface valve sub-assembly 220 includes a first dump valve 221*a*. In some implementations, the surface valve sub-assembly 220 includes a second dump valve 221*b*. Including multiple dump valves (221*a*, 221*b*) can achieve redundancy of dump valves in operation and also increase the resolution of digital valves to achieve shaping of a signal waveform. For example, an arrangement of two dump valves 221*a*, 221*b* can be implemented to shape a sinusoidal waveform. Including additional dump valves (such as three or more dump valves) can improve smoothness (for example, resolution) of the sinusoidal waveform. In some implementations, the waveform can have a shape different from a sinusoidal waveform. In some implementations, the dump valves (221*a*, 221*b* and in some cases, dump valve(s) in addition to these) can have flow orifices that vary in shape depending on a target waveform shape. In some implementations, the first and second dump valves 221*a*, 221*b* are in a parallel flow configuration. That is, the first portion 299*a* of the fluid 299 pumped by the pump 211 is split between the first and second dump valves 221*a*, 221*b*, as opposed to a serial flow configuration in which the first portion 299*a* of the fluid 299 would flow through the first dump valve 221*a* and then through the second dump valve 221*b*. The surface valve sub-assembly 220 includes a surface controller 223 that is communicatively coupled to the first dump valve 221*a*. In some implementations, the surface controller 223 is communicatively coupled to the second dump valve 221*b*. The surface controller 223 is configured to adjust fluid flow through the first dump valve 221*a*. In some implementations, the surface controller 223 is configured to adjust fluid flow through the second dump valve 221*b*. The surface sub-system 210 includes a return line 213 in fluid communication with the first dump valves 221*a*. In some implementations, the return line 213 is in fluid communication with the second dump valve 221*b*. The return line 213 is configured to flow fluid from the first dump valve 221*a*, the second dump valve 221*b*, or both the first and second dump valves 221*a*, 221*b* to the container 213.

The downhole sub-system 250 is configured to be disposed within the wellbore (for example, within a downhole portion of the well 100). The downhole sub-system 250 includes a turbine-generator 251 configured to generate an output in response to receiving a second portion 299*b* of the fluid 299 pumped by the pump 211. The output generated by the turbine-generator 251 can be, for example, a frequency output, a power output, a current output, or a voltage output. The turbine-generator 251 includes a turbine and a generator coupled together. The turbine receives fluid flow and rotates in response to receiving the fluid flow. The generator generates power in response to the rotation of the turbine. In some implementations, the turbine of the turbine-generator 251 is substituted by another hydraulic equipment, such as a vane motor. In some implementations, the downhole sub-system 250 includes a circulation valve 252 downstream of the turbine-generator 251. The downhole sub-system 250 includes a downhole controller 253 coupled to the turbine-generator 251. In implementations in which the downhole sub-system 250 includes the circulation valve 252, the downhole controller 253 is communicatively coupled to the circulation valve 252. In some implementation, the downhole controller 253 is configured to adjust fluid flow through the circulation valve 252 at least based on the output generated by the turbine-generator 251. In some implementations, the downhole sub-system 250 is coupled to the surface valve sub-assembly 220. In some implementations, the coiled tubing 290 couples the pump 211 to the turbine-generator 251.

In some implementations, the surface controller 223 includes a surface processor and a surface computer-readable storage medium coupled to the surface processor. The surface computer-readable storage medium stores programming instructions for execution by the surface processor, and the programming instructions instruct the surface processor to perform operations. In some implementations, the downhole controller 253 includes a downhole processor and a downhole computer-readable storage medium coupled to the downhole processor. The downhole computer-readable storage medium stores programming instructions for execution by the downhole processor, and the programming instructions instruct the downhole processor to perform operations. An example of the surface controller 223 and the downhole controller 253 is provided in FIG. 6 and is described in more detail later.

The split of the fluid 299 pumped by the pump 211 into the first portion 299*a* and the second portion 299*b* can be controlled by the surface controller 223. For example, the surface controller 223 is configured to adjust the percent openings of the first and second dump valves 221*a*, 221*b*, thereby controlling the flow rate of the first portion 299*a*. In some implementations, the second portion 299*b* is a remaining balance of the fluid 299 in relation to the first portion 299*a*. Controlling the flow rate of the first portion 299*a* indirectly affects the flow rate of the second portion 299*b* based on hydraulics. For example, the surface controller 233 can adjust the percent openings of the first and second dump valves 221*a*, 221*b*, such that the flow rate of the first portion 299*a* increases and the flow rate of the second portion 299*b* decreases. For example, the surface controller 233 can adjust the percent openings of the first and second dump valves 221*a*, 221*b*, such that the flow rate of the first portion 299*a* decreases and the flow rate of the second portion 299*b* increases. In some implementations, the surface controller 223 is configured to adjust a split of the first portion 299*a* between the first dump valve 221*a* and the second dump valve 221*b*.

In some implementations, the surface controller 223 is configured to adjust an amount of the first portion 299*a* by adjusting the fluid flow through each of the first and second dump valves 221*a*, 221*b*, such that a sinusoidal signal is hydraulically transmitted to the downhole sub-system 250 via the second portion 299*b*. For example, the surface controller 223 can adjust the amount of the first portion 299*a* by adjusting the fluid flow through each of the first and second dump valves 221*a*, 221*b* in such a manner that the flow rate of the second portion 299*b* alternates between increasing and decreasing in an oscillating behavior similar to a sinusoidal curve. In some implementations, the surface controller 223 is configured to modulate the sinusoidal signal that is hydraulically transmitted to the downhole sub-system 250 via the second portion 299*b*. For example, the sinusoidal signal can be modulated with frequency shift-keying (FSK), phase-shift keying (PSK), a pulse position modulation (PPM) scheme, into Morse code, or any other conventional signal modulation scheme. In some implementations, a "data packet" hydraulically transmitted to the downhole sub-system 250 via the second portion 299*b* includes a sync bits component, a payload data component, and a checksum component. The sync bits components can be used to prepare the recipient (for example, the turbine-generator 251 communicatively coupled to the downhole controller 253) of an incoming data packet. The payload data component can include a command signal allocated in a predetermined bits string and sequence. The checksum component can include a polynomial division value of the payload data bit pattern, which can in turn be used to control the integrity of the received data packet.

In some implementations, the turbine-generator 251 is configured to receive the sinusoidal signal via the second portion 299*b* and change the output in response to receiving the sinusoidal signal. In some implementations, the downhole controller 253 is configured to process the change in the output and adjust fluid flow through the circulation valve 252 at least based on processing the change in the output. For example, in cases where the output generated by the turbine-generator 251 is a frequency output, the downhole controller 253 can be configured to process the change in the frequency output for controlling an alternating electric machine. For example, in cases where the output generated by the turbine-generator 251 is a current output, the downhole controller 253 can be configured to process the change in the current output for controlling a continuous load of an electric machine. In some implementations, the downhole controller 253 is configured to process the change in the output of the turbine-generator 251, such that a power output of the turbine-generator 251 is maintained to be greater than a minimum power output threshold. The minimum power output threshold can be defined, for example, as the minimum amount of power necessary for operating the integrated electronic circuitry of a downhole tool string. In some implementations, the minimum power output threshold is in a range of from about 1 milliwatt (mW) to about 50 watts (W), from about 1 mW to about 40 W, from about 1 mW to about 30 W, from about 1 mW to about 20 W, from about 1 mW to about 10 W, or from about 1 mW to about 5 W. In some implementations, the downhole controller 253 is configured to de-modulate the sinusoidal signal that is hydraulically transmitted to the downhole sub-system 250 via the second portion 299*b*.

Figure 3:
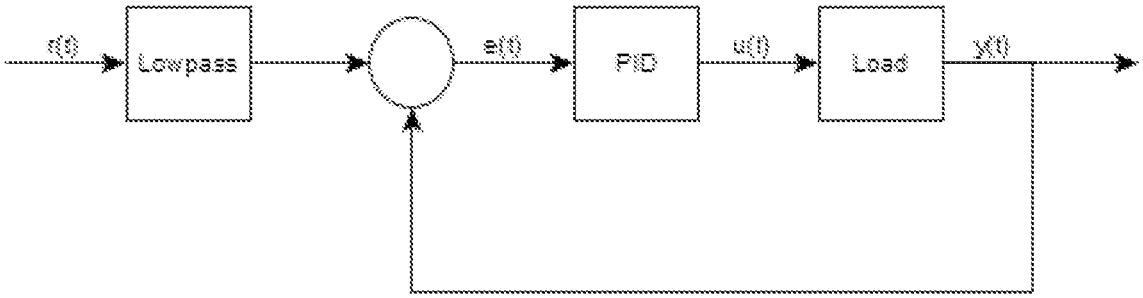
FIG. 3 is a block diagram of an example controller that can be implemented in the system of FIG. 2A.

FIG. 3 is a block diagram of an implementation of the downhole controller 253. In some implementations, the downhole controller 253 is a proportional-integral-derivative (PID) controller. The r(t) is the target process value (also referred as set point), and y(t) is the measured process value (also referred as operating point). In some implementations, the downhole controller 253 implements a feedback loop and calculates error value e(t) as the difference between the set point (e(t)) and the operating point (y(t)). The downhole controller 253 adjusts u(t) to minimize e(t) over time. The proportional component of the PID controller is proportional to the value of e(t). The integral component of the PID controller accounts for past values of e(t) and integrates them over time. The derivative component of the PID controller estimates a future value of e(t) based on a rate of change of e(t). The value for u(t) is calculated based on these three components and adjusted to minimize e(t), so that the operating point is maintained in proximity to the set point. In some implementations, r(t) passes through a lowpass filter. In some implementations, the downhole controller 253 adjusts u(t), such that the power output (for example, y(t)) is maintained to be greater than a minimum power output threshold. For example, the downhole controller 253 calculates the difference between the target voltage output turbine-generator 251 and the actual measured value and adjusts the load to minimize this difference.

The downhole controller 253 is configured to maintain steady power production while the low frequency sinusoidal signal causes low frequency fluctuations on the output generated by the turbine-generator 251. For example, low frequency fluctuations can typically range from about 0.01 Hertz (Hz) to about 2 Hz. The downhole controller 253 is slower than the low frequency sinusoidal signal but fast enough to react to actual changes in operating conditions within a reasonable timeframe (for example, in a range of from about 1 minute to 3 minutes) to enable steady power supply to other onboard equipment that may be included in the downhole sub-system 250. For example, the response time for the downhole controller 253 is longer than the duration of (that is, wavelength) of the low frequency sinusoidal signal, such that the downhole controller 253 does not interfere with and compensates for the load of the turbine-generator 251, resulting in a steady voltage output of the turbine-generator 251. The lowpass filtering with a long time constant and a hard limit can be implemented to ensure steady power production. In some implementations, the time constant ($\tau$) is calculated as $$\tau = \frac{1}{2\pi f_c}.$$

For example, for a 0.1 Hz filter, the time constant is about 1.6 seconds. In some implementations, the hard limit is an absolute minimum voltage that is set to be greater than the voltage of a battery of the downhole sub-system 250 in order to protect the battery and avoid draining/wasting energy while the turbine-generator 251 produces power. For example, the hard limit can be 8 volts (V) for a 7.2 V battery pack, such as two 3.6 V lithium cells in series.

Figure 4A:
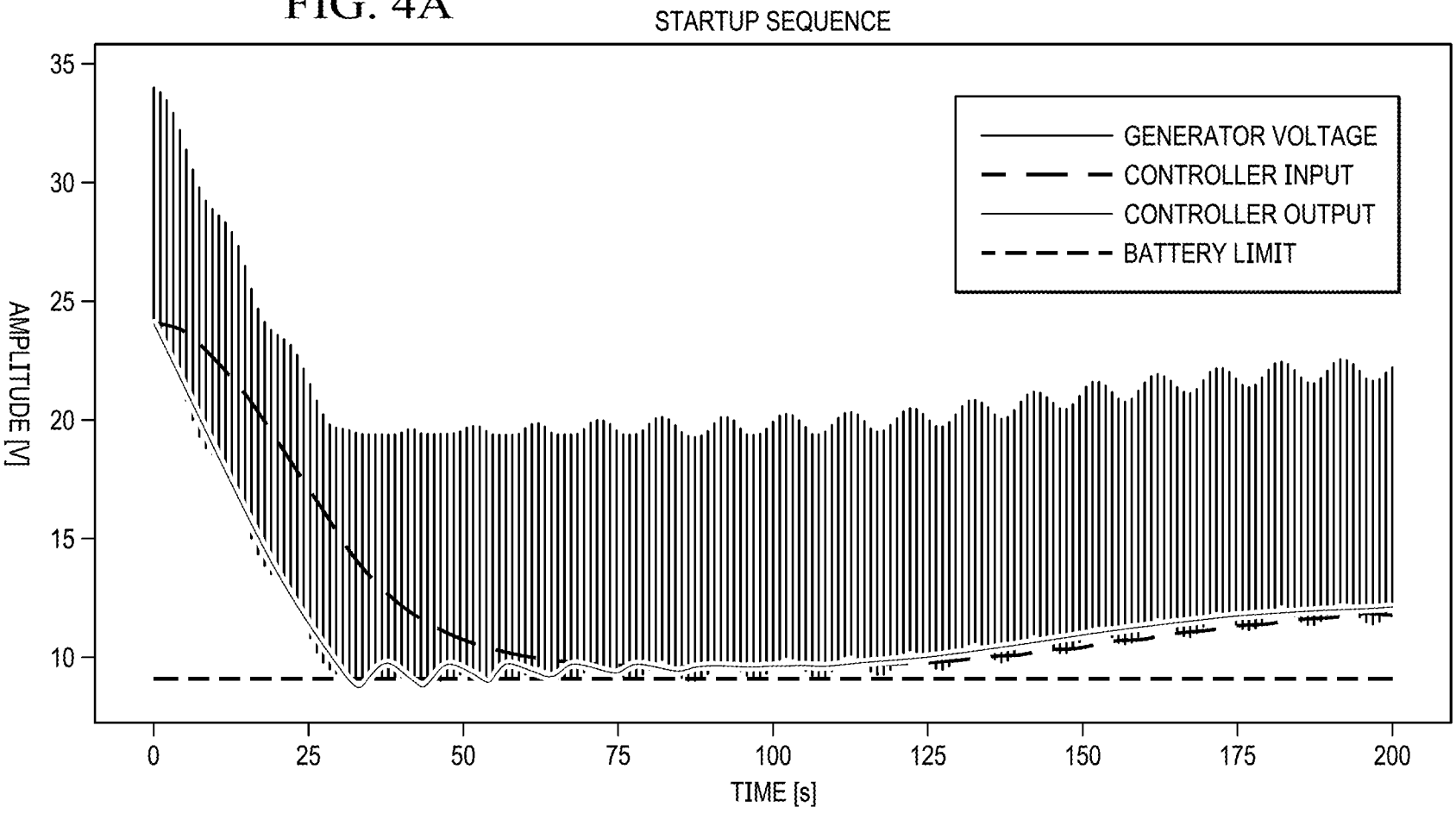
FIG. 4A is a plot of various voltages vs. time relating to an example turbine-generator and controller.
Figure 4B:
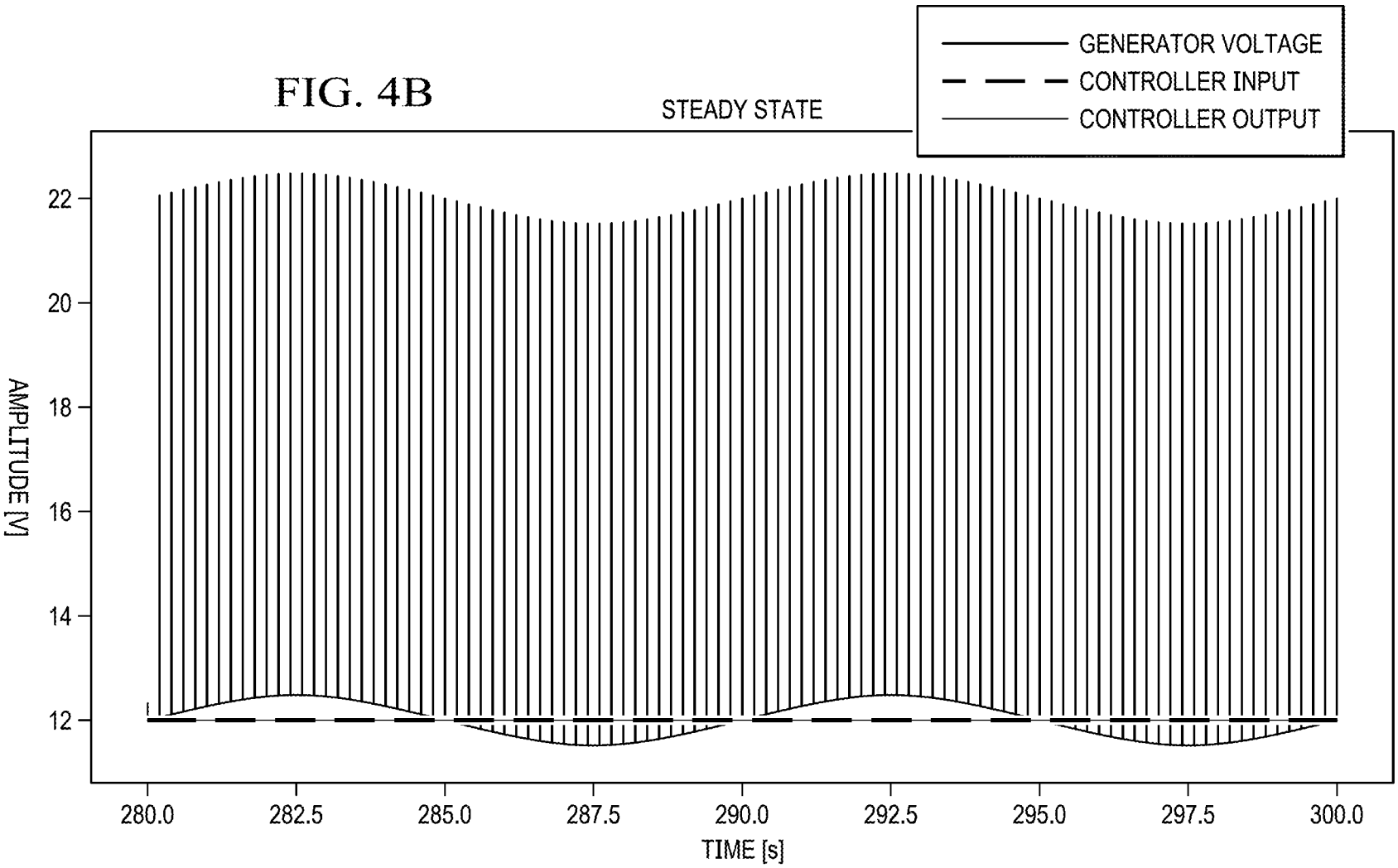
FIG. 4B is a plot of various voltages vs. time relating to an example turbine-generator and controller.

FIGS. 4A and 4B are plots of various voltages against different time scales relating to the turbine-generator 251 and the downhole controller 253. FIG. 4A depicts data associated with a startup sequence, while FIG. 4B depicts data associated with operation at steady state a time period after startup when the process has stabilized. As seen in both plots, low frequency behavior is exhibited by the voltage output of the turbine-generator 251, and the operating point (controller output) is maintained to ensure steady power production. In both plots, "Controller Input" can be considered e(t), "Controller Output" can be considered y(t), and "Generator Voltage" can be considered u(t). As seen in the plot of FIG. 4B, the voltage output of the turbine-generator 251 exhibits the low frequency sinusoidal signal, while the downhole controller 253 is stable and does not affect the load of the turbine-generator 251. This effect shown in FIG. 4B is a result of the downhole controller 253 operating more slowly than the low frequency sinusoidal signal (described previously).

Figure 5:
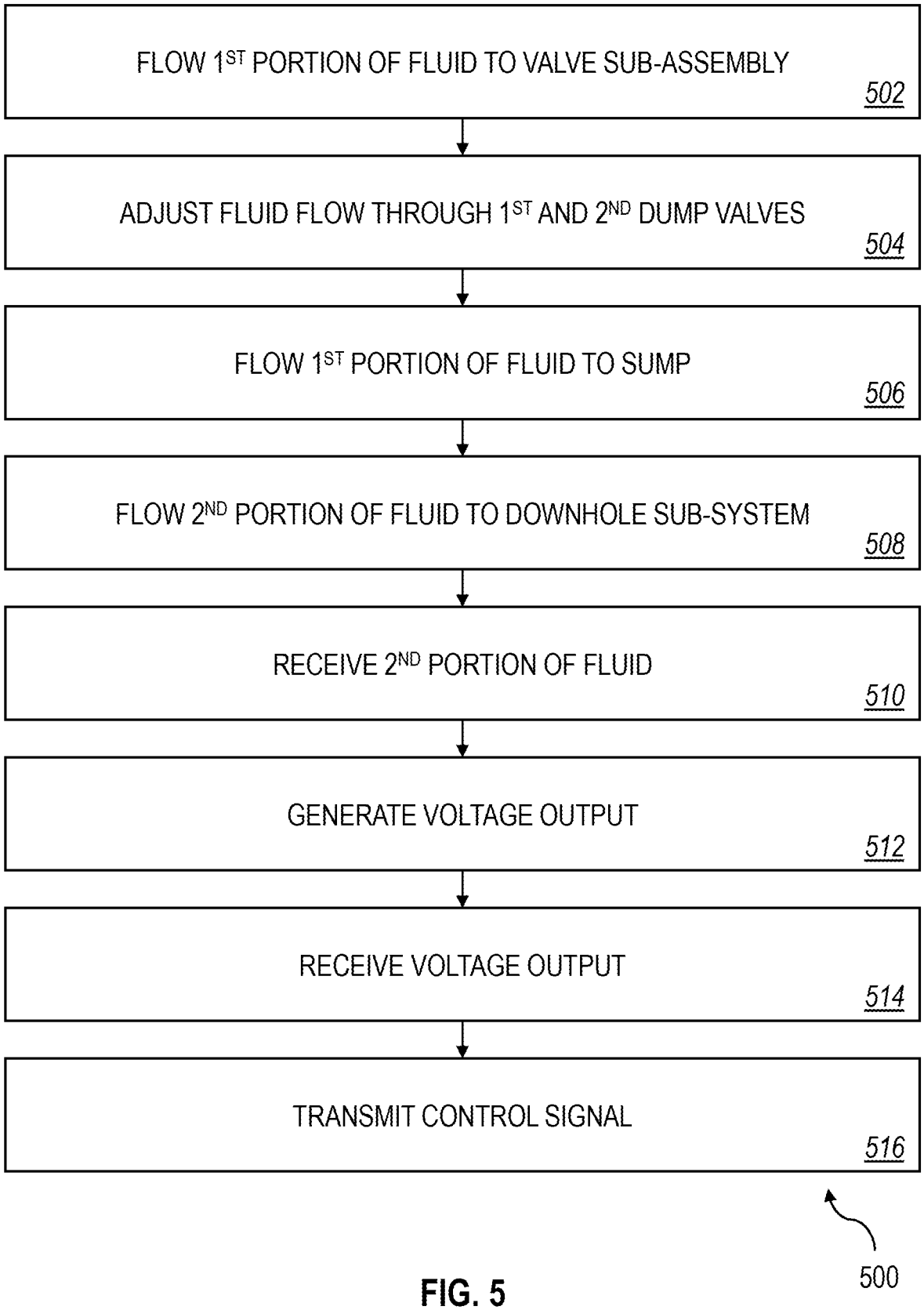
FIG. 5 is a flow chart of an example method for wireless communication between surface and downhole equipment.

FIG. 5 is a flow chart of an example method 500 for wireless communication from surface equipment to downhole equipment. The method 500 can be implemented, for example, by system 200. At step 502, a first portion of a fluid (such as the first portion 299*a* of the fluid 299) is flowed from a container (such as the container 212) to a surface valve sub-assembly (such as the surface valve sub-assembly 220). As mentioned previously, the surface valve sub-assembly includes the first dump valve 221*a*, the second dump valve 221*b*, the surface controller 223, and the return line 213. The surface controller 223 is communicatively coupled to the first and second dump valves 221*a*, 221*b*. The return line 213 is in fluid communication with the first and second dump valves 221*a*, 221*b*.

At step 504, fluid flow through each of the first and second dump valves 221*a*, 221*b* is adjusted by the surface controller 223. In some implementations, the first and second dump valves 221*a*, 221*b* are in a parallel flow configuration. In some implementations, the method 500 includes adjusting, by the surface controller 223, a split of the first portion 299*a* between the first dump valve 221*a* and the second dump valve 221*b*. In some implementations, adjusting the fluid flow through each of the first and second dump valves 221*a*, 221*b* at step 504 includes adjusting the fluid flow through each of the first and second dump valves 221*a*, 221*b*, such that a sinusoidal signal is hydraulically transmitted to the downhole sub-system 251 via a second portion (such as the second portion 299*b*) of the fluid 299. In some implementations, the method 500 includes modulating, by the surface controller 223, the sinusoidal signal that is hydraulically transmitted to the downhole sub-system 250 via the second portion 299*b*. At step 506, the first portion 299*a* of the fluid 299 is flowed by the return line 213 back to the container 212.

At step 508, the second portion 299*b* of the fluid 299 is flowed from the container 212 to a downhole sub-system disposed within a wellbore (such as the downhole sub-system 250 disposed within the well 100). As mentioned previously, the downhole sub-system 250 includes the turbine-generator 251 and the downhole controller 253. The downhole controller 253 is coupled to the turbine-generator 251. In some implementations, flowing the second portion 299*b* to the downhole sub-system 250 at step 508 includes flowing the second portion 299*b* through a coiled tubing (such as the coiled tubing 290) that is fluidically coupled to the turbine-generator 251. At step 510, the second portion 299*b* of the fluid 299 is received by the turbine-generator 251.

At step 512, an output (for example, a frequency output, a power output, a current output, or a voltage output) is generated by the turbine-generator 251 in response to receiving the second portion 299*b* of the fluid 299 at step 510. At step 514, the output (and/or a change in the output) from the turbine-generator 251 (generated at step 512) is received by the downhole controller 253. In some implementations, receiving the second portion 299*b* by the turbine-generator 251 at step 510 includes receiving the sinusoidal signal via the second portion 299*b* and changing the output generated by the turbine-generator 251 at step 512 in response to receiving the sinusoidal signal. In some implementations, the method 500 includes de-modulating, by the downhole controller 253, the sinusoidal signal that is hydraulically transmitted to the downhole sub-system 250 via the second portion 299*b*. At step 516, the downhole controller 253 transmits a signal to control another component of the downhole sub-system 250 (such as the circulation valve 252 or another component of the downhole toolstring) in response to receiving the output from the turbine-generator 251 at step 514. Power generation by the turbine-generator 251 remains steady throughout steps 512, 514, and 516.

In some implementations, the downhole sub-system 250 includes a circulation valve (such as the circulation valve 252) downstream of the turbine-generator 251 and communicatively coupled to the downhole controller 253. In some implementations, the method 500 includes processing, by the downhole controller 253, the change in the output, for example, generated by the turbine-generator 251 at step 512 in response to receiving the sinusoidal signal. In some implementations, the method 500 includes adjusting, by the downhole controller 253, fluid flow through the circulation valve 252 at least based on the processing of the change in the output, for example, generated by the turbine-generator 251 at step 512 in response to receiving the sinusoidal signal. In some implementations, processing, by the downhole controller 253, the change in the output includes processing the change in the output, such that the power output of the turbine-generator 251 is maintained to be greater than a minimum power output threshold.

Figure 6:
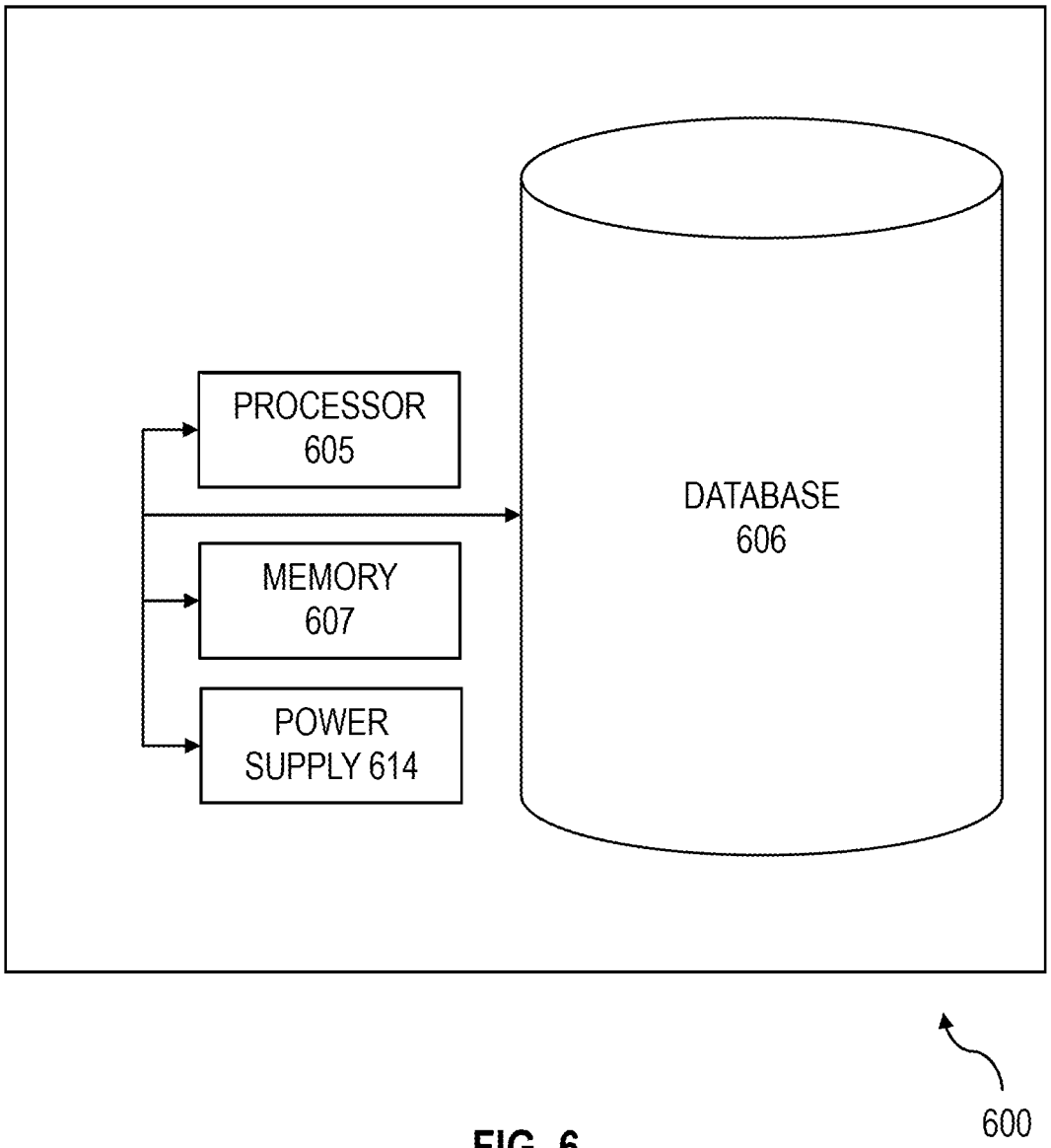
FIG. 6 is a block diagram of an example controller that can be implemented in the system of FIG. 2A.

FIG. 6 is a block diagram of an example controller 600 used to provide computational functionalities associated with described algorithms, methods, functions, processes, flows, and procedures, as described in this specification, according to an implementation. For example, each of the surface controller 223 and the downhole controller 253 can be implementations of the controller 600. The illustrated controller 600 is intended to encompass any computing device such as a server, desktop computer, laptop/notebook computer, one or more processors within these devices, or any other processing device, including physical or virtual instances (or both) of the computing device. Additionally, the controller 600 can include a computer that includes an input device, such as a keypad, keyboard, touch screen, or other device that can accept user information, and an output device that conveys information associated with the operation of the computer 600, including digital data, visual, audio information, or a combination of information.

The controller 600 includes a processor 605. Although illustrated as a single processor 605 in FIG. 6, two or more processors may be used according to particular needs, desires, or particular implementations of the controller 600. Generally, the processor 605 executes instructions and manipulates data to perform the operations of the controller 600 and any algorithms, methods, functions, processes, flows, and procedures as described in this specification.

The controller 600 can also include a database 606 that can hold data for the controller 600 or other components (or a combination of both) that can be connected to the network. Although illustrated as a single database 606 in FIG. 6, two or more databases (of the same or combination of types) can be used according to particular needs, desires, or particular implementations of the controller 600 and the described functionality. While database 606 is illustrated as an integral component of the controller 600, database 606 can be external to the controller 600.

The controller 600 includes a memory 607 that can hold data for the controller 600 or other components (or a combination of both) that can be connected to the network. Although illustrated as a single memory 607 in FIG. 6, two or more memories 607 (of the same or combination of types) can be used according to particular needs, desires, or particular implementations of the controller 600 and the described functionality. While memory 607 is illustrated as an integral component of the controller 600, memory 607 can be external to the controller 600. The memory 607 can be a transitory or non-transitory storage medium.

The memory 607 stores controller-readable instructions executable by the processor 605 that, when executed, cause the processor 605 to perform operations, such as adjust fluid flow through each of the first and second dump valves 221*a*, 221*b*. The controller 600 can also include a power supply 614. The power supply 614 can include a rechargeable or non-rechargeable battery that can be configured to be either user- or non-user-replaceable. The power supply 614 can be hard-wired. There may be any number of controllers 600 associated with, or external to, a computer system containing controller 600, each controller 600 communicating over the network. Further, the term "client," "user," "operator," and other appropriate terminology may be used interchangeably, as appropriate, without departing from this specification. Moreover, this specification contemplates that many users may use one controller 600, or that one user may use multiple controllers 600.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A system comprising:

a surface sub-system comprising:

a pump configured to pump a fluid from a container, downhole into a wellbore; and a surface valve sub-assembly fluidically coupled to the pump and configured to receive a first portion of the fluid pumped by the pump, the surface valve sub-assembly comprising:

a first dump valve;

a second dump valve, wherein the first dump valve and the second dump valve are in a parallel flow configuration;

a surface controller communicatively coupled to the dump valve, the surface controller configured to adjust fluid flow through the dump valve; and a return line in fluid communication with the dump valve, the return line configured to flow fluid from the dump valve to the container;

a downhole sub-system coupled to the surface valve sub-assembly and configured to be disposed within the wellbore, the downhole sub-system comprising:

a turbine-generator configured to generate an output in response to receiving a second portion of the fluid pumped by the pump; and a downhole controller coupled to the turbine-generator.

2. The system of claim 1, wherein the downhole sub-system and the surface valve sub-assembly are coupled by a coiled tubing that fluidically couples the pump to the turbine-generator.

3. The system of claim 2, wherein the surface controller comprises:

a surface processor; and a surface computer-readable storage medium coupled to the surface processor and storing programming instructions for execution by the surface processor, the programming instructions instructing the surface processor to perform operations comprising adjusting an amount of the first portion of the fluid pumped by the pump by adjusting fluid flow through each of the first dump valve and the second dump valve, such that a sinusoidal signal is hydraulically transmitted to the downhole sub-system via the second portion of the fluid pumped by the pump.

4. The system of claim 3, wherein the turbine-generator is configured to receive the sinusoidal signal via the second portion of the fluid pumped by the pump and change the output in response to the receiving the sinusoidal signal, and the downhole controller is configured to process the change in the output.

5. The system of claim 4, wherein the surface controller is configured to modulate the sinusoidal signal that is hydraulically transmitted to the downhole sub-system via the second portion of the fluid pumped by the pump, and the downhole controller is configured to de-modulate the sinusoidal signal that is hydraulically transmitted to the downhole sub-system via the second portion of the fluid pumped by the pump.

6. The system of claim 5, wherein the downhole controller is configured to process the change in the output of the turbine-generator, such that a power output of the turbine-generator is maintained to be greater than a minimum power output threshold.

7. A method comprising:

flowing a first portion of a fluid from a container to a surface valve sub-assembly, the surface valve sub-assembly comprising:

a first dump valve;

a second dump valve, wherein the first dump valve and the second dump valve are in a parallel flow configuration;

a surface controller communicatively coupled to the first dump valve; and a return line in fluid communication with the first dump valve;

adjusting, by the surface controller, fluid flow through the first dump valve;

adjusting, by the surface controller, a split of the first portion of the fluid between the first dump valve and the second dump valve;

flowing, by the return line, the first portion of the fluid to the container;

flowing a second portion of the fluid from the container to a downhole sub-system disposed within a wellbore, the downhole sub-system comprising a turbine-generator and a downhole controller coupled to the turbine-generator, wherein flowing the second portion of the fluid from the container to the downhole sub-system comprises flowing the second portion of the fluid through a coiled tubing fluidically coupled to the turbine-generator;

receiving, by the turbine-generator, the second portion of the fluid;

generating, by the turbine-generator, an output in response to receiving the second portion of the fluid;

receiving, by the downhole controller, the output from the turbine-generator; and transmitting, by the downhole controller, a control signal in response to receiving the output from the turbine-generator.

8. The method of claim 7, wherein adjusting the split of the first portion of the fluid between the first dump valve and the second dump valve comprises adjusting the fluid flow through each of the first dump valve and the second dump valve, such that a sinusoidal signal is hydraulically transmitted to the downhole sub-system via the second portion of the fluid.

9. The method of claim 8, comprising receiving, by the turbine-generator, the sinusoidal signal via the second portion of the pump and changing the output generated by the turbine-generator in response to receiving the sinusoidal signal.

10. The method of claim 9, wherein:

the downhole sub-system comprises a circulation valve downstream of the turbine-generator, the circulation valve communicatively coupled to the downhole controller; and the method comprises:

processing, by the downhole controller, the change in the output; and adjusting, by the downhole controller, fluid flow through the circulation valve at least based on the processing of the change in the output.

11. The method of claim 10, comprising:

modulating, by the surface controller, the sinusoidal signal that is hydraulically transmitted to the downhole sub-system via the second portion of the fluid; and de-modulating, by the downhole controller, the sinusoidal signal that is hydraulically transmitted to the downhole sub-system via the second portion of the fluid.

12. The method of claim 11, wherein processing the change in the output comprises processing the change in the output, such that the power output of the turbine-generator is maintained to be greater than a minimum power output threshold.

13. A system comprising:

a surface sub-system configured to receive a first portion of a fluid pumped by a pump positioned at a surface location, the surface sub-system comprising:

a plurality of dump valves in a parallel flow configuration;

a surface controller communicatively coupled to the plurality of dump valves, the surface controller configured to adjust fluid flow through each of the plurality of dump valves; and a return line in fluid communication with the plurality of dump valves, the return line configured to flow fluid from the plurality of dump valves to a container that provides feed to the pump; and a downhole sub-system configured to be disposed within a wellbore, the downhole sub-system comprising:

a turbine-generator configured to generate an output in response to receiving a second portion of the fluid pumped by the pump;

a circulation valve downstream of the turbine-generator; and a downhole controller coupled to the turbine-generator and communicatively coupled to the circulation valve, the downhole controller configured to adjust fluid flow through the circulation valve in response to receiving the output from the turbine-generator.

14. The system of claim 13, wherein the downhole sub-system and the surface sub-system are coupled by a coiled tubing.

15. The system of claim 14, wherein:

the surface controller comprises:

a surface processor; and a surface computer-readable storage medium coupled to the surface processor and storing surface programming instructions for execution by the surface processor, the surface programming instructions instructing the surface processor to perform surface operations; and the downhole controller comprises:

a downhole processor; and a downhole computer-readable storage medium coupled to the downhole processor and storing downhole programming instructions for execution by the downhole processor, the downhole programming instructions instructing the downhole processor to perform downhole operations.

* * * * *